US006069613A

United States Patent [19]

Lewis

[11] Patent Number: 6,069,613

[45] Date of Patent: May 30, 2000

[54] BASIC INPUT-OUTPUT SYSTEM (BIOS) READ-ONLY MEMORY (ROM) INCLUDING EXPANSION TABLE FOR EXPANDING MONOCHROME IMAGES INTO COLOR IMAGE

[75] Inventor: Timothy A. Lewis, Fremont, Calif.

[73] Assignee: Phoenix Technologies Ltd., San Jose, Calif.

[21] Appl. No.: 08/951,601

[22] Filed: Oct. 16, 1997

[51] Int. Cl.[7] ..... G09G 5/04

[52] U.S. Cl. ..... 345/153; 345/141; 345/192

[58] Field of Search ..... 345/501–503, 345/520, 521, 523, 507, 509, 194, 195, 153, 155, 192

[56] References Cited

U.S. PATENT DOCUMENTS

| | | | |
|---|---|---|---|
| Re. 33,894 | 4/1992 | Bradley | 345/186 |
| 4,437,093 | 3/1984 | Bradley | 345/125 |
| 5,319,395 | 6/1994 | Larky et al. | 345/515 |
| 5,404,445 | 4/1995 | Matsumoto | 345/520 |
| 5,438,652 | 8/1995 | Zenda | 345/431 |
| 5,581,788 | 12/1996 | Ballare | 710/14 |
| 5,603,011 | 2/1997 | Piazza | 345/431 |
| 5,774,126 | 6/1998 | Chatterjee et al. | 345/431 |
| 5,835,100 | 11/1998 | Matsufusa | 345/467 |
| 5,835,760 | 11/1998 | Harmer | 713/2 |

FOREIGN PATENT DOCUMENTS

| | | |
|---|---|---|
| 0071725 | of 0000 | European Pat. Off. . |
| 0071744 | of 0000 | European Pat. Off. . |
| 0 071 725 | 2/1983 | European Pat. Off. . |
| 0 422 294 | 4/1991 | European Pat. Off. . |
| 0 457 039 | 11/1991 | European Pat. Off. . |
| 4405329 | of 0000 | Germany . |
| 4405330 | of 0000 | Germany . |

*Primary Examiner*—Ulka J. Chauhan
*Attorney, Agent, or Firm*—Foley & Lardner

[57] ABSTRACT

A Basic Input-Output System (BIOS) Read-Only Memory (ROM) for a computer system includes a color expansion table, and a storage for storing a computer program for generating an output character represented by bitmapped output scan lines from a corresponding input character represented by bitmapped input scan lines which have a smaller number of bits than the output scan lines. The input scan lines are each preferably one byte long, with one pixel being represented by one bit. The output scan lines are each preferably one word long, with each pixel being represented by two bits to provide four selectable colors or shades of grey. The computer program includes instructions for accessing the expansion table with the input scan lines to obtain corresponding output scan lines. The expansion table includes entries which are addressable by a nibble of an input scan line and contain a corresponding byte of an output scan line, and separate sections for the four colors. A character can be generated once, or a selected number of times, at high speed.

38 Claims, 8 Drawing Sheets

AH
AL
LOAD
0 0 0 0 0 0 0 0 1 0 0 1 0 1 1 0
AX

COPY
1 0 0 1 0 1 1 0 1 0 0 1 0 1 1 0

CLEAR
1 0 0 1 0 1 1 0 0 0 0 0 0 1 1 0

EXPAND
1 0 0 1 0 1 1 0 0 0 0 1 0 1 0 0

EXCHANGE
0 0 0 1 0 1 0 0 1 0 0 1 0 1 1 0

SHIFT
0 0 0 1 0 1 0 0 0 0 0 0 1 0 0 1

EXPAND
0 0 0 1 0 1 0 0 0 1 0 0 0 0 0 1

EXCHANGE
0 1 0 0 0 0 0 1 0 0 0 1 0 1 0 0

BASIC INPUT-OUTPUT SYSTEM (BIOS) READ-ONLY MEMORY (ROM) INCLUDING EXPANSION TABLE FOR EXPANDING MONOCHROME IMAGES INTO COLOR IMAGE

BACKGROUND OF THE INVENTION

1. Field of the Invention

The present invention generally relates to the art of digital computers, and more specifically to a Basic Input-Output System (BIOS) Read-Only Memory (ROM) including an expansion table for expanding a monochrome image into a color image.

2. Description of the Related Art

The graphic display capabilities of digital computers are constantly improving. Video modes which provide extremely high resolution and the display of hundreds of colors are now commonplace.

Older video modes such as Color Graphics Adapter (CGA) are almost obsolete. However, it is desirable to provide backward compatibility for the older modes, so that software which was written to use these modes will run on a newer computer.

There are also some applications which can benefit from running in an older, simpler graphics mode. For example, an electronic cash register in a supermarket may display only a few rows of simple text, and need nothing more than what can be provided at high speed and low complexity by a CGA text mode.

In IBM PC type computers, for example, video display services such as text display are invoked by storing input parameters in computer registers, and generating an interrupt 10h request (the letter "h" following a number indicates that it is a hexadecimal number). To maintain backward compatibility, the video display services that are invoked via interrupt 10h must be located in the computer's Basic Input-Output System (BIOS) Read-Only Memory (ROM) chip.

A video service that is commonly used is writing a bitmapped graphic text character to the video display screen in CGA mode 4 or 5. Mode 4 provides a 40 column color display with four colors. Mode 5 provides a 40 column greyscale display with 4 levels of grey.

An input text character to be written to the screen is received as an ASCII code, in which it is represented by one byte (8 binary bits). The ASCII code is used to access a bitmap table in which each character is represented by a matrix of eight scan lines, each of which consists of one byte or 8 bits.

The bitmap table includes a monochrome image of each character in which each pixel is represented by one bit, such that the pixel can appear as one of two colors (e.g. black and white). However, CGA modes 4 and 5 provide for four possible values for each pixel, such that the pixel can be one of four colors in mode 4 and one of four shades of grey in mode 5.

The color in which the character is to be displayed is selected or specified by the function which generates the interrupt and is passed to the character display routine. Various combinations involving different pallets of colors are available. However, all of the pixels of a character are displayed in the same color.

Each character in CGA mode 4 or 5 consists of eight scan lines as in the monochrome bitmapped image. However, each scan line includes one word (two bytes), with each pixel being represented by two bits. The two bit code for each pixel enables a selected one of four colors to be specified.

In order to display a bitmapped text character in CGA mode 4 or 5, the monochrome bitmap image must be expanded into a color bitmap image in which each background pixel represented by a binary "0" in the monochrome image is expanded to binary "00", and each foreground pixel represented by a binary "1" in the monochrome image is expanded to binary "01", "10", or "11" in accordance with the selected color.

European Patent No. 71725, Aug. 31, 1988, entitled "METHOD FOR SCROLLING TEXT AND GRAPHIC DATA IN SELECTED WINDOWS OF A GRAPHIC DISPLAY", to J. Bradley, teaches how to expand a monochrome bitmap image of a character into a color bitmap image one pixel at a time.

More specifically, each bit of the bitmapped image is examined individually. If the bit is "0", a "00", is stored in a corresponding location in a video display buffer for display. If the bit is "1", a "01", "10", or "11" is stored in accordance with the selected color. This procedure is undesirably slow because each bit (pixel) is expanded individually.

An improvement to the method presented by Bradley is disclosed in German Patent Application No. 4405329A1, entitled "METHOD FOR DISPLAYING TEXT ON A PC MONITOR IN THE CGA GRAPHIC MODE", published Aug. 24, 1995, to G. Paley et al. This patent teaches how to expand a scan line in a register using a sequence of shift and logical OR operations which provides a speed improvement over the Bradley system.

However, the Paley method also expands characters one pixel at a time, requires 64 program loops (8 scan lines×8 bits/scan line) to expand a single character, and is also undesirably slow.

SUMMARY OF THE INVENTION

The present invention provides an improvement over the prior art as presented above by substantially increasing the speed at which a bitmapped graphic character can be expanded from monochrome to color and stored in a video display buffer for display on a video display screen.

The invention achieves this goal by providing a method which uses a conversion or expansion table to expand bitmapped text characters one scan line at a time, rather than one pixel at a time.

More specifically, a Basic Input-Output System (BIOS) Read-Only Memory (ROM) for a computer according to the present invention includes an expansion table, and a storage for storing a computer program for generating an output character represented by bitmapped output scan lines from a corresponding input character represented by bitmapped input scan lines which have a smaller number of bits than the output scan lines.

The input scan lines are each preferably one byte long, with one pixel being represented by one bit. The output scan lines are each preferably one word long, with each pixel being represented by two bits to provide four selectable colors.

The computer program includes instructions for accessing the expansion table with the input scan lines to obtain corresponding output scan lines. The expansion table includes entries which are addressable by a nibble of an input scan line and contain a corresponding byte of an output scan line, and separate sections for the four colors. A character can be generated once, or a selected number of times, at high speed.

Program instructions for implementing the character expansion are preferably included in a storage (ROM area) of the BIOS ROM to provide a built-in, backward compatible low resolution display capability, e.g. a Color Graphics Adapter (CGA) text display, for a newer computer or other data processing device.

These and other features and advantages of the present invention will be apparent to those skilled in the art from the following detailed description, taken together with the accompanying drawings, in which like reference numerals refer to like parts.

DETAILED DESCRIPTION OF THE INVENTION

Figure 1:
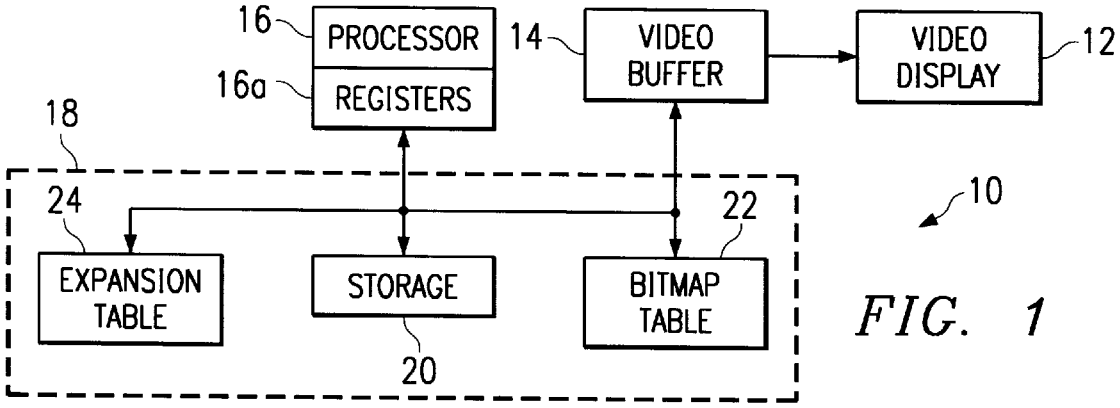
FIG. 1 is a block diagram of a computer implemented video display system including a BIOS ROM according to the present invention.

FIG. 1 illustrates a computer implemented video display system 10 including a Basic Input-Output System (BIOS) Read-Only Memory (ROM) according to the present invention.

The system 10 is implemented as a personal computer (PC) workstation or the like which conventionally includes standard components such as volatile and non-volatile memory, a keyboard, magnetic and/or optical mass storage drive, mouse, etc. which are not the subject matter of the invention and are not shown.

The system 10 includes a video display 12 having a CRT or liquid crystal display screen for displaying text and graphic images which are stored in a video memory or buffer 14. The system 10 further includes a processor 16 such as an Intel X86 or Pentium chip which includes a number of on-board registers that are collectively designated as 16*a*. The processor 16 executes program instructions that are stored in the volatile and/or non-volatile memory.

The system 10 further comprises a BIOS ROM 18 according to the present invention. The BIOS ROM 18 includes a storage 20 in the form of a ROM area which stores computer program instructions that are executed by the processor 16. The BIOS ROM 20 further includes a bitmap table 22 which stores monochrome images of bitmapped text characters in which one display pixel is represented by one binary bit. In accordance with an important feature of the present invention, the BIOS ROM 18 further includes a text character color conversion or expansion table 24 which will be described in detail below.

Figure 2:
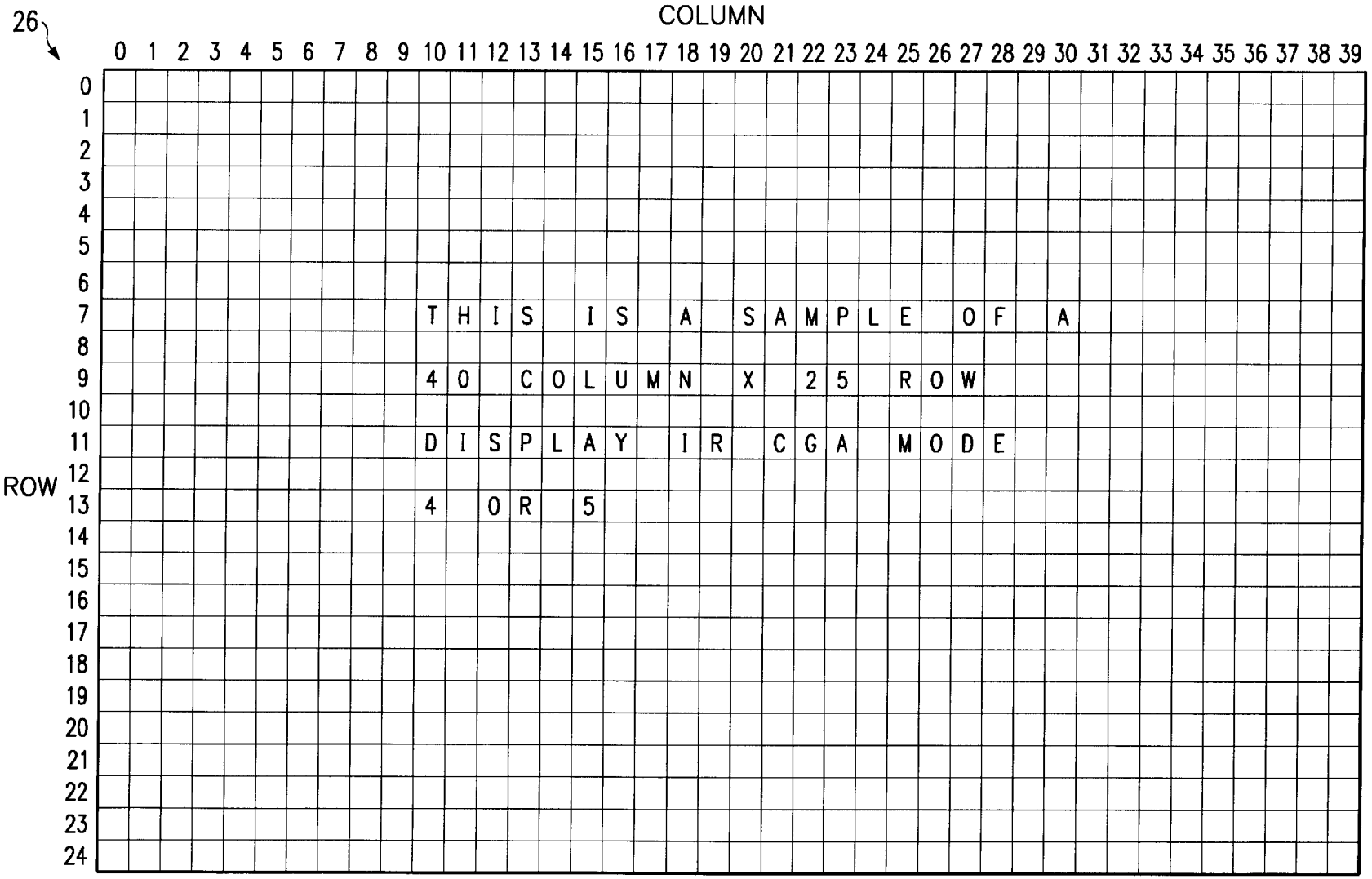
FIG. 2 is a diagram illustrating a CGA mode 4 or 5 video display.

FIG. 2 illustrates a Color Graphics Adapter (CGA) mode 4 or 5 bitmapped graphic text display 26 as stored displayed on the screen of the video display 12. The display 26 includes 40 columns×25 rows of text characters. In mode 4, each character can have one of four colors. In mode 5, each character can have one of four shades of grey. As illustrated, an exemplary text message begins at row 6, column 7 of the display 26.

Figure 3A:
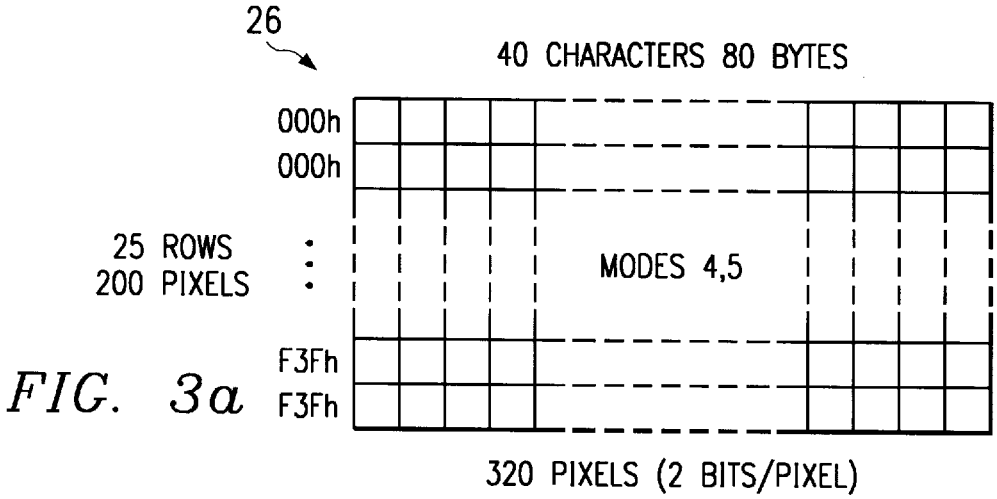
FIGS. 3*a*, 3*b* and 4 are diagrams illustrating the arrangement of a CGA video mode 4 or 5 display buffer.
Figure 3B:
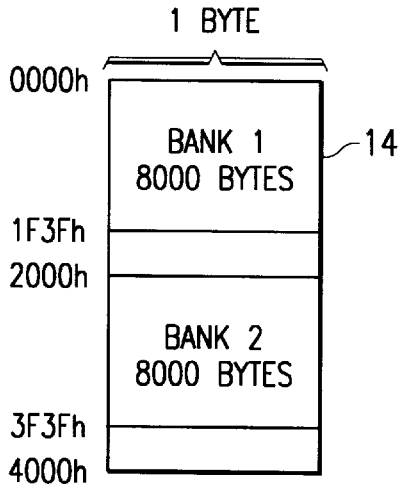
Figure 4:
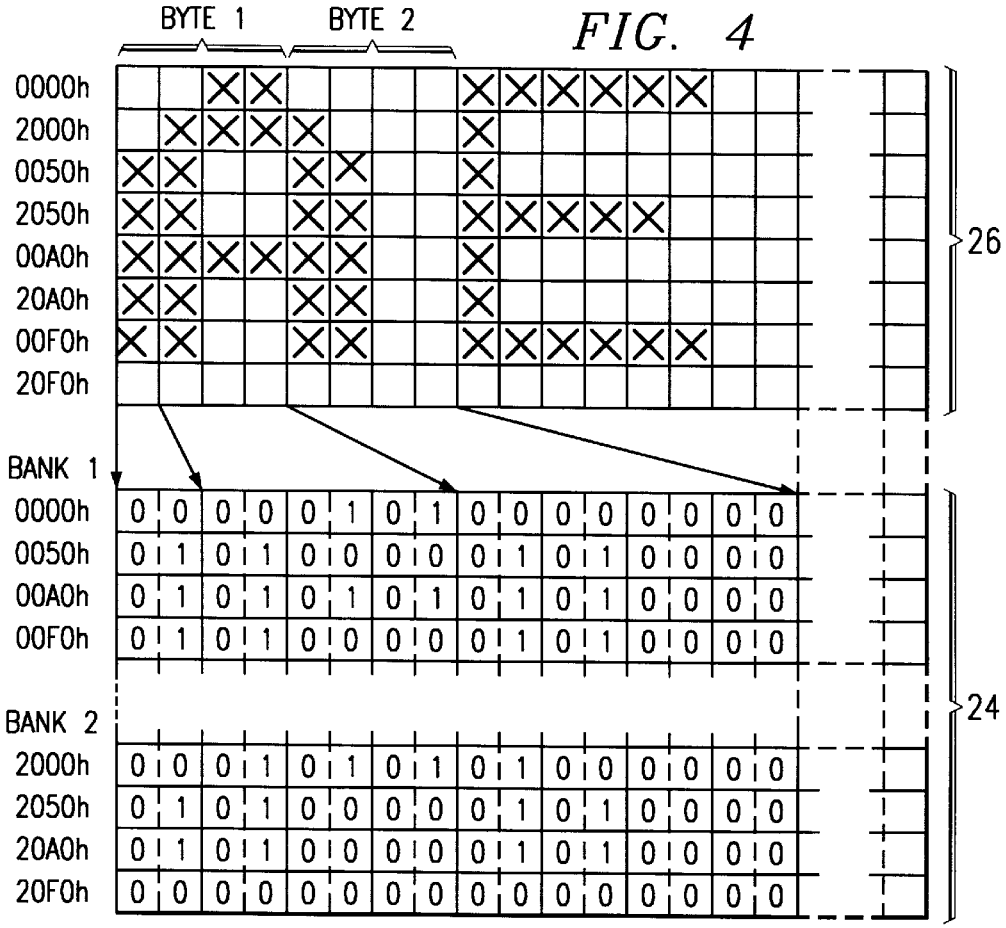

FIGS. 3*a*, 3*b* and 4 illustrate how bitmapped graphic text characters are stored in the video buffer 14 in CGA modes 4 and 5. Each character is made up of a matrix of pixels, including scan lines that are stored in different places in the video buffer 14.

As shown in FIG. 3*a*, the entire video buffer 14 stores data representing 40 columns×25 rows of text characters, with each character being represented by a matrix of 8 pixels×8 pixels. Thus, the entire display consists of 40 columns×8 pixels=320 horizontal pixels, and 25 columns×8 pixels=200 vertical pixels.

Each character includes 8 horizontal scan lines, each consisting of 2 bytes (one word or 16 bits). Since each character includes 8 horizontal pixels, each pixel is represented by 2 bits. Thus, each pixel can have one of four colors (CGA mode 4) or one of four levels of grey (CGA mode 5). The total number of bits required for the video memory is 80 bytes/row×25 rows×8 bits/byte=16,000 bits.

As shown in FIG. 3*b*, the video buffer 14 stores one byte at each memory location, and is divided into two banks of 8,000 bytes each. Bank 1 stores even scan lines, whereas Bank 2 stores odd scan lines. Although Bank 1 requires only 8,000 bytes, Bank 2 begins at 2000h which is 8192 bytes from the beginning of Bank 1.

This relationship is shown in more detail in FIG. 4, which illustrates the leftmost two exemplary characters, e.g. "A" and "C", in the first row of the buffer 14. The first scan line (2 bytes) of the character "A" is stored at locations 0000h and 0010h respectively in Bank 1. The second scan line is stored in locations 2000h and 2001h in Bank 2. The third scan line is stored in locations 0050h and 0051h in Bank 1, the fourth scan line is stored in locations 2050h and 2051h in Bank 2, etc.

Figure 5:
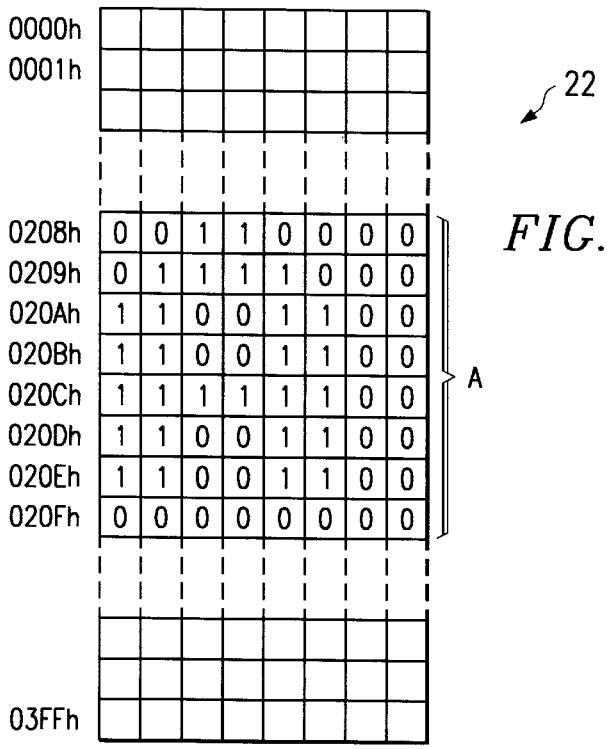
FIG. 5 is a diagram illustrating a monochrome text character bitmap table.

FIG. 5 illustrates the arrangement of the bitmap table 22 in the BIOS ROM 18. The bitmap table 22 stores monochrome graphic representations of the first 128 ASCII characters, with each pixel being represented by one bit of bitmapped data. Each "1" represents a pixel of a character, whereas a "0" represents a background pixel.

A text character to be displayed on the display 12 is received as a one byte ASCII code which is used to calculate an input address for the table 22. Since each character has 8 scan lines, the first scan line of each character is stored at a location having the address (CHAR×8), where CHAR is an input ASCII code. For example, the first scan line of the character "A" will be stored at location 0208h in the table 22, which is equal to the ASCII code 41h of the character "A" multiplied by 8, or 41h×8h=0208h.

The 8 scan lines of any character can be obtained by accessing the table 22 with the value (ASCII code×8) to get the address of the first line, and incrementing this address 7 times to get the addresses of the following 7 lines.

Figure 6:
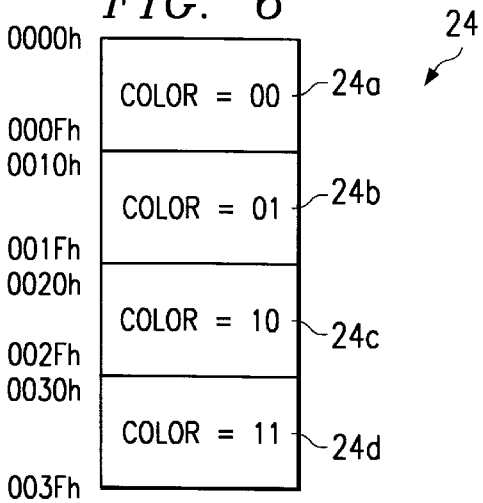
FIGS. 6 and 7 are diagrams illustrating a conversion or expansion table of the invention.

FIG. 6 illustrates the arrangement of the conversion or expansion table 24 according to the present invention. The table 22 includes four sections or segments 24*a*, 25*b*, 24*c* and 24*d* for the four possible colors or values a two bit pixel can have respectively. For example, if the function which calls for a text character to be displayed in CGA mode 4 or 5 selects or specifies the color represented by a pixel value "01", the section 24*b* will be accessed.

Each section of the table 24 is 16 bytes long, such that the total size of the table 24 is 64 bytes. The addresses of the sections of the table 24 are indicated in the drawing.

As will be described in detail below, a preferred method of practicing the present invention expands a monochrome character bitimage from the table 22 in which each character scan line is one byte long into a color character bitimage in which each character scan line is one word (2 bytes) long. The invention accesses the table 22 one nibble (one-half byte or 4 bits) at a time. Thus, the table 24 is accessed by using one nibble of a scan line from the table 22 as an address, and contains a color expanded byte corresponding to the nibble at the accessed address location.

Figure 7:
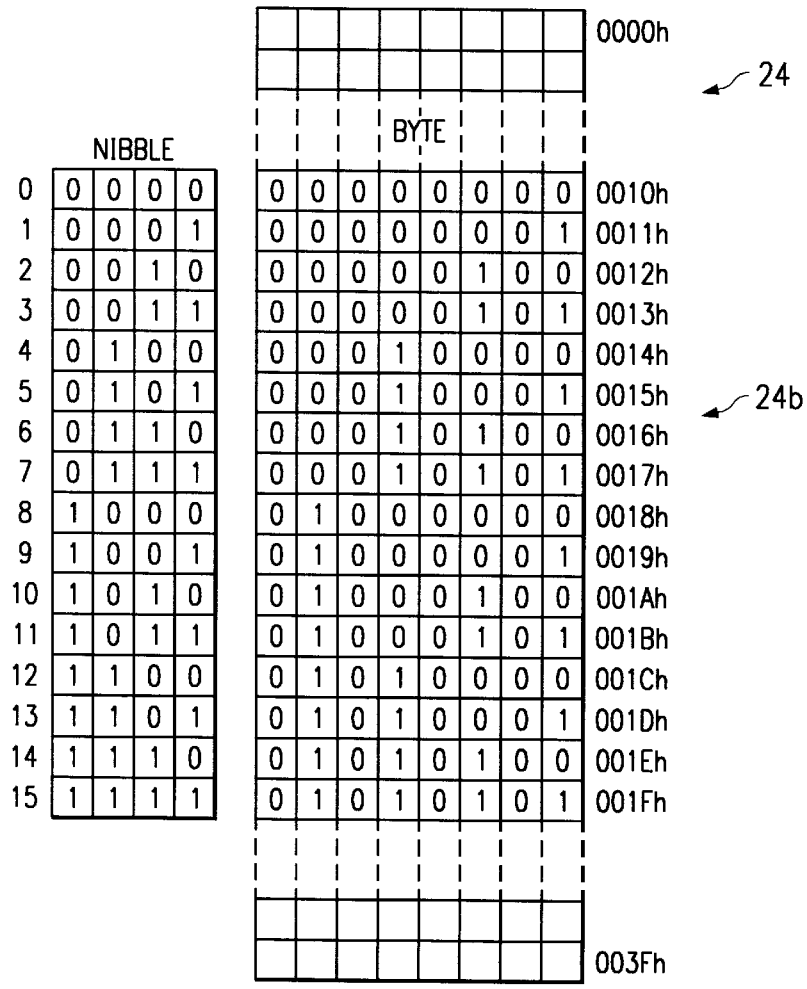

As viewed in FIG. 7, each section of the table 24 includes 16 entries which represent the 16 different values that can be represented by one nibble (4 bits) of a scan line in the table 22. The 16 entries are located at offsets from the beginning of each section 24*a* to 24*d* corresponding to the value of the nibble. As shown in FIG. 7, the section 24*b* for the color "01" starts at 0010h, which is the entry for an input nibble value of binary "0000". The entry for the next nibble value of "0001" is located at the next address 0011h, etc.

Each entry in the table 24 corresponds to the input nibble value such that each "0" in the input value is replaced by "00", and each "1" in the input value is replaced by "00", "01", "10" or "11" in the sections 24*a* to 24*d* respectively. For example, for an input nibble value "0100" at address 0014h (in section 24*b* for the color "01"), the color expanded byte has the value "00010000". The "0", "1", "0" and "0" bits in the input value "0100" are replaced by "00", "01", "00" and "00" respectively.

The overall method of the invention includes accessing the bitmap table 22 with the ASCII code of a character which is to be displayed in CGA mode 4 or 5 to obtain the bitmapped monochrome scan lines. Each monochrome scan line is color expanded in accordance with the selected color and written to the video buffer 14 for display on the video display 12.

FIGS. 8*a* to 8*h* illustrate how one monochrome scan line obtained from the table 22 is color expanded in accordance with a preferred embodiment of the present invention. The expansion is performed using one of the registers 16*a*. The processor 16 will be assumed to have an IBM x86 or Pentium compatible architecture and instruction set, and the register in which the expansion is performed will be taken as the accumulator register AX.

Figures 8A, 8B, 8C, 8D, 8E, 8F, 8G, 8H:
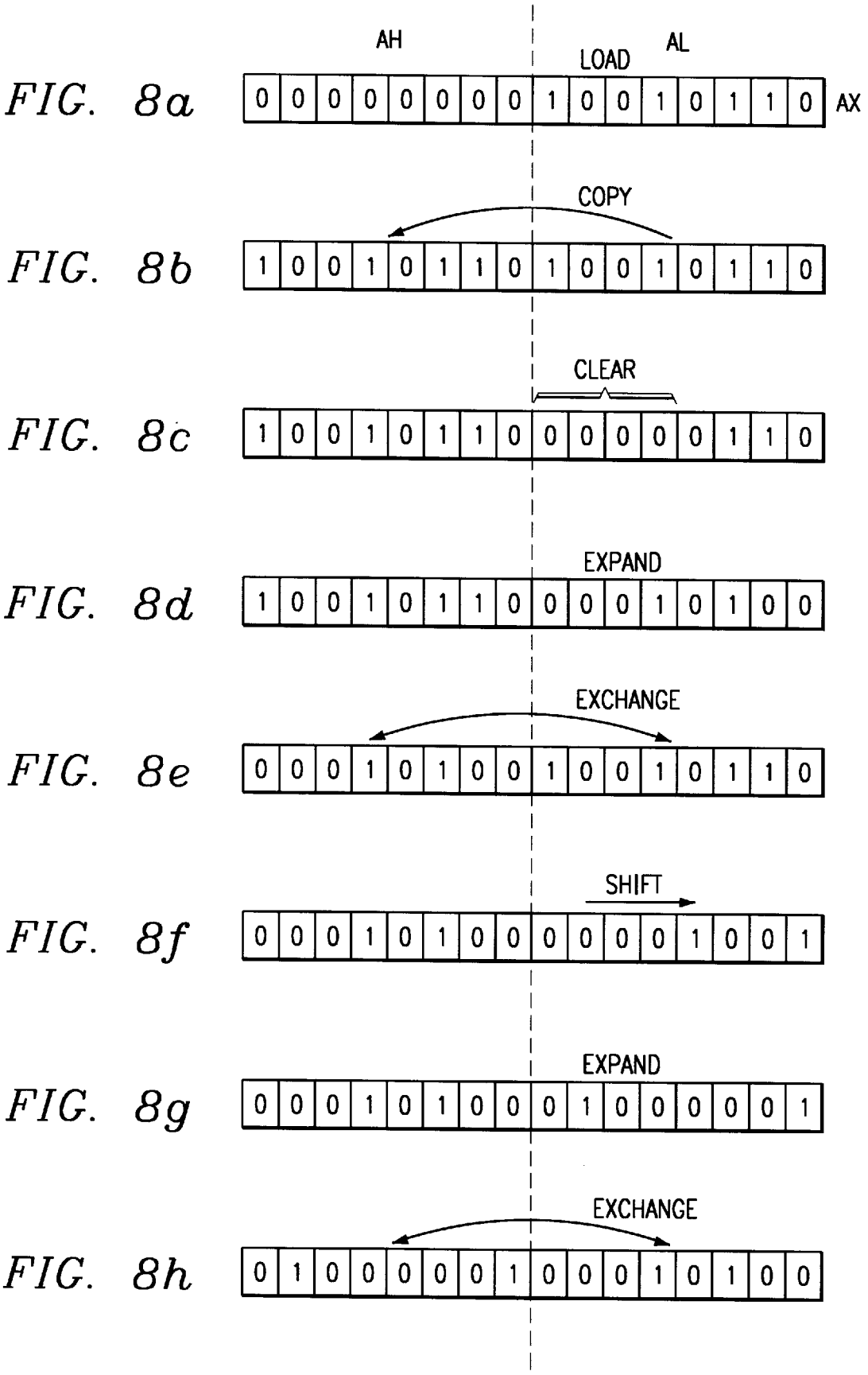
FIGS. 8*a* to 8*h* are diagrams illustrating a color expansion operation of the invention.

As shown in FIG. 8*a*, the accumulator register AX has a size of 16 bits, and is divided into an high order byte section AH and a low order byte section AL that can be accessed independently. The first step of the expansion process is to load an input scan line (one byte) obtained from the table 22 into the register section AL. The input scan line in the example of FIGS. 8*a* to 8*h* has the binary value "10010110" (92h), and the selected color is "01".

In FIG. 8*b*, the one byte scan line in the section AL is copied into the section AH. In FIG. 8*c*, the high order 4 bits in the section AL are cleared by, for example, performing a logical AND operation between the value in the section AL and the binary number "00001111". This isolates the low order nibble of the input scan line, and makes room for expansion of the low order nibble to a size of one byte in the section AL.

The nibble expansion is performed in FIG. 8*d*. This is preferably accomplished using a translate instruction such as "xlat" in the x86 instruction set which accesses the expansion table 24 using the nibble value as an address (offset into the table) and replaces the value in the register section AL with the entry in the table 24 at the accessed address. Thus, the value "00000110" is replaced by the value "00010100" in the register section AL.

The actual offset address into the table 24 is calculated by multiplying the color value by 16 (10h) to obtain the base of the section 24*a* to 24*d*, and adding the nibble value to the base value. In the example of FIG. 8*d*, the offset into the table 24 is "01" (color)×10h=0010h (base of section 24*b* for color "01")+"0110" or 6h (nibble value)=0016h. The expanded value of "00010100" is found at this address as illustrated in FIG. 7.

After the expansion of the low order nibble has been accomplished, the contents of the AL and AH register sections are exchanged or swapped as illustrated in FIG. 8*e*. This step is necessary using the conventional x86 instruction set in which the "xlat" instruction will only work for the low order register section AL.

The high order nibble (4 bits) of the monochrome scan line is isolated as illustrated in FIG. 8*f* by shifting the register section AL right by 4 bits to produce a configuration which is equivalent to that of FIG. 8*c*, except that the high order nibble of the input monochrome scan line now occupies the low order 4 bits of the register section AL.

The high order nibble is expanded in FIG. 8*g* in the same manner as described above for the low order nibble with reference to FIG. 8*d*. The high order nibble has a value of "1001" (0009h), and points to location 0019h in the table 24. The expanded value which is found in this location and translated into the register section AL is "01000001".

In FIG. 8*h*, the contents of the register sections AL and AH are exchanged so that the high order byte of the expanded scan line is in AH and the low order byte is in AL. Thus, the input monochrome scan line byte "10010110" is expanded to "0100000100010100" in the accumulator register AX.

FIGS. 9*a* to 9*d* in combination constitute a flowchart of a method for generating an output character according to the present invention.

The process is begun by a calling function inputting a variable CHAR which is the ASCII character to be displayed on the video display 12, a variable COLOR which specifies a selected character color "00" to "11", a variable MODE which specifies a store or exclusive-OR (XOR) mode, and a variable COUNT which specifies the number of times the character CHAR is to be written to the video buffer 14 for display on the video display 12. These variables are passed in using registers, and the calling function generates an interrupt 10h request which internally pushes the variables onto the stack and sets up a variable "bp" which points to them.

In the PC x86 and Pentium compatible architecture, the variables are accessed using a standard IBM core video request for BIOS service, in this case a CGA mode text display service.

Sample code for calling interrupt 10h is as follows.

```
        mov ah,9          ;write character function
        mov a1,'-'        ; character to write
        mov b1,2          ; color
        mov cx,20         ; write hyphen 20 times
    int 10h
```

The code which is executed by interrupt 10h performs the following basic flow.

```
pusha              ; Save all registers on the stack
mov bp,sp          ; bp =3D sp (and is now a pointer to
                     regStack)
.
.
.
check function in ah and jump to appropriate routine
.
.
popa
iret
```

Figure 9A:
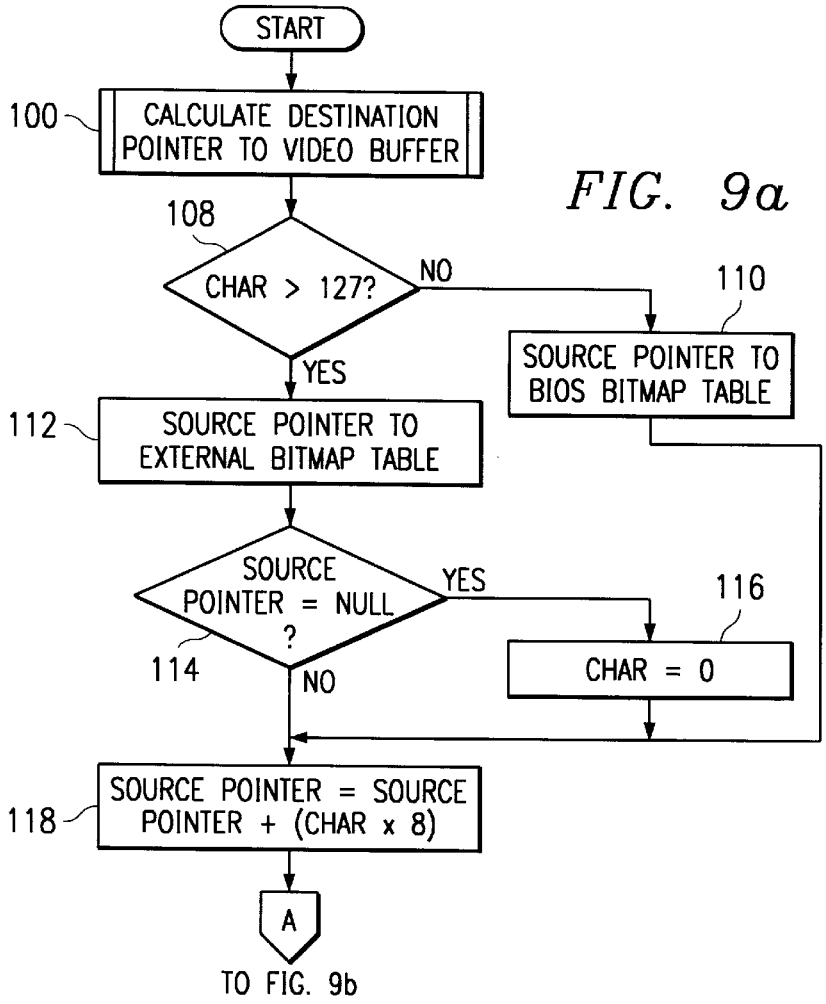
FIGS. 9*a* to 9*d* in combination constitute a flowchart illustrating a method performed by computer program instructions according to the invention.

After these initialization operations have been performed, the flow begins at a step 100 in FIG. 9*a* which calls a routine to calculate a destination pointer DEST to the address in Bank 1 of the video buffer 14 in which the first scan line of the character is to be written.

Figure 9C:
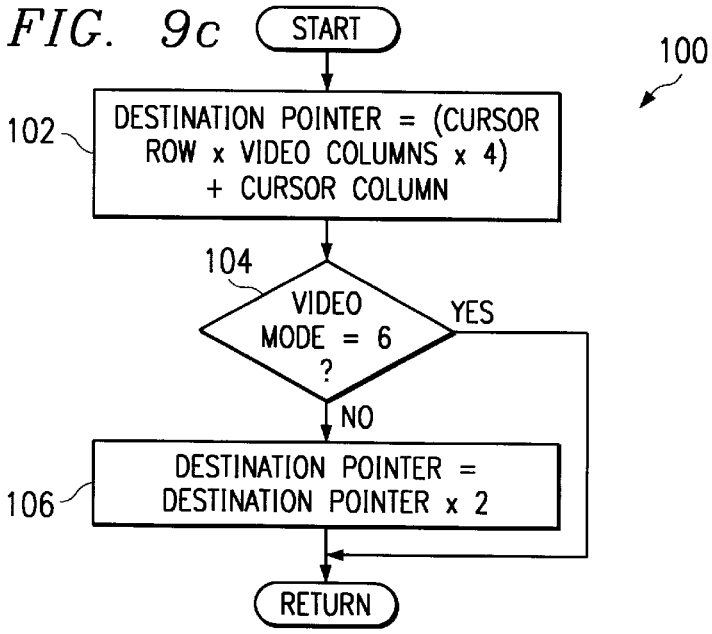

This routine is illustrated in FIG. 9*c*. The destination pointer DEST is calculated in a step 102 from the cursor row and column location that is conventionally maintained by the BIOS ROM routines. Taking the display 26 of FIG. 2 as an example, it will be assumed that the first character "T" is to be displayed at row 6, column 7.

The value of the pointer DEST is calculated as DEST=(cursor row×video columns×4)+cursor column. The value of video columns is the maximum number of columns that can be displayed, and is 40 for modes 4 and 5 and 80 for mode 6. In the example of FIG. 2, the value DEST=(6×40×4)+7=967 or 03C7h. The multiplication by 4 is performed because four scan lines of each character are stored in each of Bank 1 and Bank 2 of the video buffer 14 as described above with reference to FIGS. 3*a*, 3*b* and 4.

A test is made in a step 104 to determine if the requested service is for CGA mode 6. This is an 80 column×25 row monochrome text mode which is not the subject matter of the invention, and step 104 is included to maintain compatibility with existing BIOS services.

If the video mode is not CGA mode 6, the destination pointer DEST is multiplied by two in a step 106. This is done because each video column (character) scan line is represented by two bytes in CGA modes 4 and 5. In the present example, this gives a value of DEST=1934 (078Eh).

Returning to FIG. 9*a*, the next step 108 which is performed after calculation of the destination pointer is to determine if the ASCII character code is larger than 127 (007Fh). As described above, only the first 128 ASCII characters are provided in the bitmap table 22 in the BIOS ROM 18. If a larger number of characters are desired, they must be stored in an external user supplied bitmap table (not shown).

If the value of CHAR is not larger than 127, a source pointer SOURCE is set to point to the base of the bitmap table 22 in a step 110. If the value of CHAR is larger than 127, the source pointer SOURCE is set to point to the base of an external bitmap table in a step 112.

A step 114 is provided for compatibility with the standard BIOS services. It is possible that due to an error in the calling function, no external bitmap table was specified by the input routine. In this case, the value of CHAR is set to zero in a step 116.

The last step 118 in FIG. 9*a* is to calculate a new value for the source pointer SOURCE as the location in the bitmap table 22 (or external bitmap table) from which the first scan line of the input character CHAR is to be read. This value is calculated by adding the value (CHAR×8) to the base address of the bitmap table 22 (from step 110) or external bitmap table (from step 112) as described above with reference to FIG. 5.

Figure 9B:
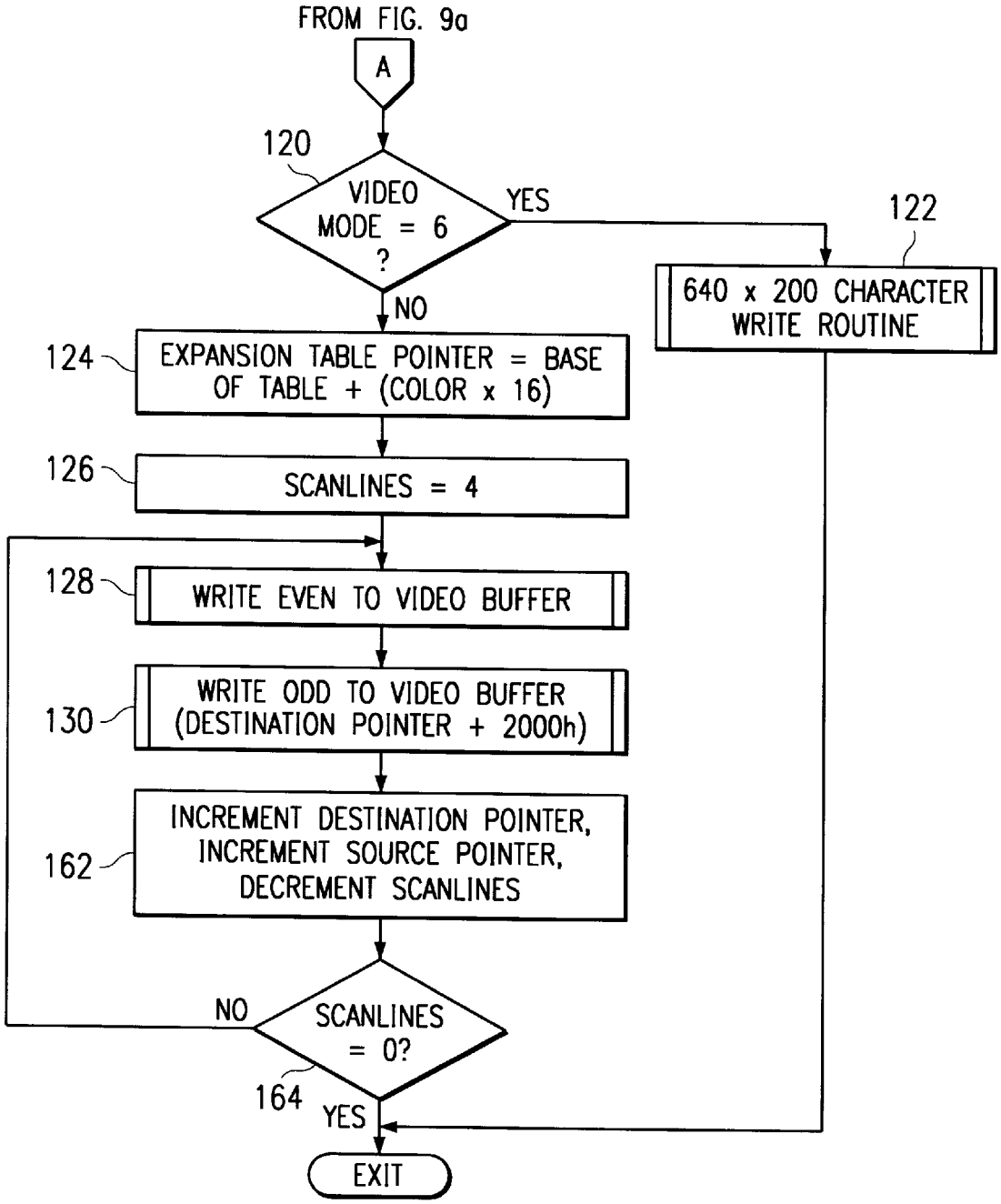

The process flow is continued in FIG. 9*b* as indicated by a link "A". A step 120 checks to see if the requested service is CGA mode 6. If so, an 80 column×25 line monochrome text character write routine 122 is performed which is not the particular subject matter of the invention, after which the process terminates.

If the video mode is not CGA mode 6, an expansion pointer EXPAND is calculated in a step 124. The pointer EXPAND points to the base address of the section 24*a* to 24*d* in the expansion table 24 for the selected color. As described with reference to FIG. 6, this value is calculated as the base address of the table 24 plus COLOR×16 (0010h).

Step 126 initializes a counter variable SCANLINES to 4. The variable SCANLINES is used to count the number of scan lines that are read out of the table 22, expanded, and written to Bank 1 and Bank 2 the video buffer 14.

Figure 9D:
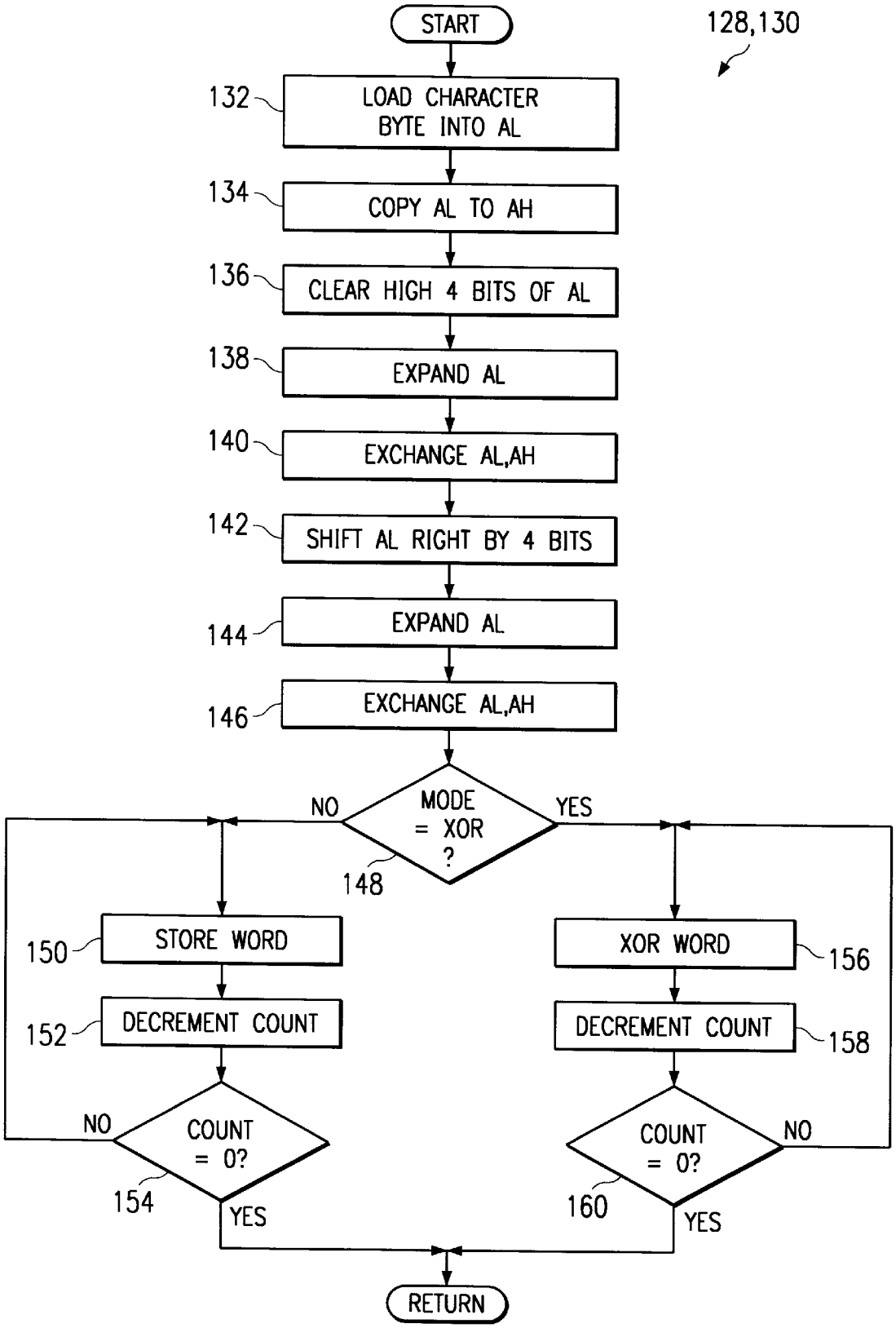

Step 128 calls a routine that is illustrated in FIG. 9*d* for expanding an even scan line (byte) from the bitmap table 22 and writing the expanded scan line (word) in Bank 1 of the video buffer 14. Step 130 calls the routine of FIG. 9*d* for expanding an odd scan line from the bitmap table 22 and writing the expanded scan line in Bank 2 of the video buffer 14. Step 130 differs from step 128 in that 2000h is added to the current value of the destination pointer DEST to point to the base address of Bank 2 of the video buffer 14.

As illustrated in FIG. 9*d*, steps 132 to 136 correspond to the operations which were described above with reference to FIGS. 8*a* to 8*h* respectively. The result is that a color expanded scan line (word) is stored in the accumulator register AX.

Step 148 tests to determine if the variable MODE is store or exclusive-OR (XOR). If the mode is store, the expanded scan line (word) in the register AX is stored in the location pointed to by the destination pointer DEST in the video buffer 14 in a step 150, and the variable COUNT is decremented in a step 152. A test is made in a step 154 to check if the variable COUNT has been decremented to zero. If so, the process returns to the flow of FIG. 9*b* as will be described below.

If the variable MODE is XOR, the expanded scan line in the register AX is exclusive OR'd with the contents of the location pointed to by the destination pointer DEST in a step 156. The XOR operation is performed when it is desired to superimpose a new image on an existing image in the video buffer 14.

If a bit of the new image is "0", the existing bit is not changed. If the bit of the new image is "1", the existing bit is inverted. This makes it possible, for example, to write a white character on an existing white background, since the "00" bits of the existing white background will be inverted to "11" (e.g. black), and the new white character will stand out from the new black background. Step 158 decrements the value of the variable COUNT, and a step 160 checks to see if the variable COUNT has been decremented to zero.

After the step 154 or 160 produces a YES result, the routine of FIG. 9*d* returns to the step 130 of FIG. 9*b* if an even scan line was written, or to a step 162 if an odd scan line was written. The step 162 increments the destination pointer DEST, increments the source pointer SOURCE, and decrements the counter variable SCANLINES in preparation for expanding and writing the next scan line. If a step 164 determines that all scan lines of the character have been expanded and written, the process exits to the calling function. If one or more scan lines remain to be expanded and written, the process loops back to the step 128.

The variable COUNT enables a character to be written to the video buffer 14 a plurality of times at high speed. As long as the variable COUNT has not been decremented to zero, the process flow of FIG. 9*d* loops back to step 150 or 156 from step 154 to 160 to repeatedly store or XOR the scan line that was expanded in the steps 132 to 146. This arrangement is especially efficient because the character scan line only has to be expanded once no matter how many times the character is to be written to the video buffer 134.

In summary, the present invention provides an improved method, video display system and BIOS ROM which substantially increase the speed at which a bitmapped graphic character can be expanded from monochrome to color and stored in a video display buffer for display on a video display screen. The invention achieves this goal by using a conversion or expansion table to expand bitmapped text characters one scan line at a time, rather than one pixel at a time.

Various modifications will become possible for those skilled in the art after receiving the teachings of the present disclosure without departing from the scope thereof.

For example, although the invention has been described and illustrated as using a conversion table to generate an output character from an input character in which the scan lines of the output character have more bits than the scan lines of the input character, the invention is not so limited, and is further applicable to, for example, an arrangement in which the scan lines of the output character have less bits than the scan lines of the input character.

What is claimed is:

1. In a computer implemented video display system, a method for generating an output character represented by bitmapped output scan lines from a corresponding input character represented by bitmapped input scan lines which have a different number of bits than the output scan lines, comprising the steps of:

(a) providing a conversion table including entries which are addressable by at least a portion of an input scan line and contain a corresponding at least a portion of an output scan line; and (b) accessing the conversion table with the input scan lines to obtain corresponding output scan lines, wherein each input scan line includes one bit per pixel, and each output scan line includes two bits per pixel in which the two bits representing each pixel of the output character for which the input pixel has a first binary value have the first binary value, and the two bits representing each pixel of the output character for which the input pixel has a second binary value have a selected one of the second binary value, a third binary value and a fourth binary value.

2. A method as in claim 1, in which the output scan lines have more bits than the input scan lines.

3. A method as in claim 1, in which each input scan line includes one byte of bitmapped data, and each output scan line includes one word of bitmapped data.

4. A method as in claim 3, in which:

each entry in the conversion table is addressable by one nibble of an input scan line and contains one byte of a corresponding output scan line; and step (b) comprises the substeps, for each input scan line, of:

(b1) accessing the conversion table with a first nibble of the input scan line to obtain a first byte of the corresponding output scan line; and (b2) accessing the conversion table with a second nibble of the input scan line to obtain a second byte of the corresponding output scan line.

5. A method as in claim 1, in which the output scan lines include a larger number of bits per pixel than the input scan lines.

6. A method as in claim 1, in which the first to fourth binary values are 00, 01, 10 and 11 respectively.

7. A method as in claim 1, in which:

the conversion table comprises first, second and third sections in which the two bits representing each pixel of the output character for which the input pixel has the second binary value have the second, third and fourth binary values respectively; and step (b) comprises accessing one of the three sections in accordance with a selected one of the second, third and fourth binary values.

8. A method as in claim 7, in which:

the conversion table has a fourth section in which the two bits representing each pixel of the output character for which the input pixel has the first binary value have the first binary value; and step (b) comprises accessing the fourth section in accordance with selection of the first binary value.

9. A method as in claim 1, in which step (b) comprises generating an output character a selected number of times from an input character by accessing the conversion table with the input scan lines to obtain corresponding output scan lines said selected number of times.

10. A method as in claim 9, in which step (b) comprises accessing the conversion table with each input scan line said selected number of times.

11. In a computer implemented video display system, a method for generating an output character represented by bitmapped output scan lines from a corresponding input character represented by bitmapped input scan lines which have a different number of bits than the output scan lines, comprising the steps of:

(a) providing a conversion table including entries which are addressable by at least a portion of an input scan line and contain a corresponding at least a portion of an output scan line; and (b) accessing the conversion table with the input scan lines to obtain corresponding output scan lines, wherein step (b) comprises the substeps, for accessing the conversion table with each input scan line, of:

(b1) storing the input scan line in a storage area; and (b2) executing a translation instruction which causes the conversion table to be accessed such that the input scan line is replaced by a corresponding output scan line in the storage.

12. A method as in claim 11, in which the storage is a computer register.

13. A computer implemented video display system for generating an output character represented by bitmapped output scan lines from a corresponding input character represented by bitmapped input scan lines which have a different number of bits than the output scan lines, comprising the steps of:

a conversion table including entries which are addressable by at least a portion of an input scan line and contain a corresponding at least a portion of an output scan line; and a computer for accessing the conversion table with the input scan lines to obtain corresponding output scan lines, wherein each input scan line includes one bit per pixel, and each output scan line includes two bits per pixel in which the two bits representing each pixel of the output character for which the input pixel has a first binary value have the first binary value, and the two bits representing each pixel of the output character for which the input pixel has a second binary value have a selected one of the second binary value, a third binary value and a fourth binary value.

14. A system as in claim 13, in which the output scan lines have more bits than the input scan lines.

15. A system as in claim 13, in which each input scan line includes one byte of bitmapped data, and each output scan line includes one word of bitmapped data.

16. A system as in claim 15, in which:

each entry in the conversion table is addressable by one nibble of an input scan line and contains one byte of a corresponding output scan line; and the computer, for each input scan line, accesses the conversion table with a first nibble of the input scan line to obtain a first byte of the corresponding output scan line; and accesses the conversion table with a second nibble of the input scan line to obtain a second byte of the corresponding output scan line.

17. A system as in claim 13, in which the output scan lines include a larger number of bits per pixel than the input scan lines.

18. A system as in claim 13, in which the first to fourth binary values are 00, 01, 10 and 11 respectively.

19. A system as in claim 13, in which:

the conversion table comprises first, second and third sections in which the two bits representing each pixel of the output character for which the input pixel has the second binary value have the second, third and fourth binary values respectively; and the computer accesses one of the three sections in accordance with a selected one of the second, third and fourth binary values.

20. A system as in claim 19, in which:

the conversion table has a fourth section in which the two bits representing each pixel of the output character for which the input pixel has a first binary value have the first binary value; and the computer accesses the fourth section in accordance with selection of the first binary value.

21. A system as in claim 13, in which the computer generates an output character a selected number of times from an input character by accessing the conversion table with the input scan lines to obtain corresponding output scan lines said selected number of times.

22. A system as in claim 21, in which the computer accesses the conversion table with each input scan line said selected number of times.

23. A computer implemented video display system for generating an output character represented by bitmapped output scan lines from a corresponding input character represented by bitmapped input scan lines which have a different number of bits than the output scan lines, comprising:

a conversion table including entries which are addressable by at least a portion of an input scan line and contain a corresponding at least a portion of an output scan line;

a computer for accessing the conversion table with the input scan lines to obtain corresponding output scan lines; and a storage, wherein for each scan line, the computer accesses the conversion table with the input scan line and stores the input scan line in the storage; and executes a translation instruction which causes the conversion table to be accessed such that the input scan line is replaced by a corresponding output scan line in the storage.

24. A system as in claim 23; in which the storage comprises a register.

25. A Basic Input-Output System (BIOS) Read-Only Memory (ROM) comprising:

a conversion table; and a storage for storing a computer program for generating an output character represented by bitmapped output scan lines from a corresponding input character represented by bitmapped input scan lines which have a different number of bits than the output scan lines, in which:

the conversion table includes entries which are addressable by at least a portion of an input scan line and contain a corresponding at least a portion of an output scan line; and the computer program includes instructions for accessing the conversion table with the input scan lines to obtain corresponding output scan lines.

26. A BIOS ROM as in claim 25, in which the output scan lines have more bits than the input scan lines.

27. A BIOS ROM as in claim 25, in which each input scan line includes one byte of bitmapped data, and each output scan line includes one word of bitmapped data.

28. A BIOS ROM as in claim 27, in which:

each entry in the conversion table is addressable by one nibble of an input scan line and contains one byte of a corresponding output scan line; and the computer program includes instructions, for each input scan line, for accessing the conversion table with a first nibble of the input scan line to obtain a first byte of the corresponding output scan line; and accessing the conversion table with a second nibble of the input scan line to obtain a second byte of the corresponding output scan line.

29. A BIOS ROM as in claim 25, in which the output scan lines include a larger number of bits per pixel than the input scan lines.

30. A BIOS ROM as in claim 25, in which each input scan line includes one bit per pixel, and each output scan line includes two bits per pixel.

31. A BIOS ROM as in claim 30, in which the two bits representing each pixel of the output character for which the input pixel has a first binary value have the first binary value; and the two bits representing each pixel of the output character for which the input pixel has a second binary value have a selected one of the second binary value, a third binary value and a fourth binary value.

32. A BIOS ROM as in claim 31, in which the first to fourth binary values are 00, 01, 10 and 11 respectively.

33. A BIOS ROM as in claim 31, in which:

the conversion table comprises first, second and third sections in which the two bits representing each pixel of the output character for which the input pixel has a second binary value have the second, third and fourth binary values respectively; and the computer program includes instructions for accessing one of the three sections in accordance with a selected one of the second, third and fourth binary values.

34. A BIOS ROM as in claim 33, in which:

the conversion table has a fourth section in which the two bits representing each pixel of the output character for which the input pixel has a first binary value have the first binary value; and the computer program includes instructions for accessing the fourth section in accordance with selection of the first binary value.

35. A BIOS ROM as in claim 25, in which the computer program includes instructions for generating an output character a selected number of times from an input character by accessing the conversion table with the input scan lines to obtain corresponding output scan lines said selected number of times.

36. A BIOS ROM as in claim 35, in which the computer program includes instructions for accessing the conversion table with each input scan line said selected number of times.

37. A BIOS ROM as in claim 25, in which the computer program includes instructions for accessing the conversion table with each input scan line by storing the input scan line in a storage; and executing a translation instruction which causes the conversion table to be accessed such that the input scan line is replaced by a corresponding output scan line in the storage.

38. A BIOS ROM as in claim 37, in which the storage is a computer register.

* * * * *